US010222189B2

(12) United States Patent
Reimann et al.

(10) Patent No.: US 10,222,189 B2
(45) Date of Patent: Mar. 5, 2019

(54) STAGE SEPARATION MECHANISM AND METHOD

(71) Applicant: Raytheon Company, Waltham, MA (US)

(72) Inventors: Daniel D. Reimann, Tucson, AZ (US); Jeffery R. Richards, Tucson, AZ (US); Charles M. Hoke, Reno, NV (US); Robert D. Travis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 109 days.

(21) Appl. No.: 15/217,491

(22) Filed: Jul. 22, 2016

(65) Prior Publication Data

US 2018/0023933 A1 Jan. 25, 2018

(51) Int. Cl.
*F42B 15/36* (2006.01)

(52) U.S. Cl.
CPC ..... *F42B 15/36* (2013.01)

(58) Field of Classification Search
CPC ..... F42B 15/36; F42B 39/20; F42B 3/006; B64G 1/645; B64G 1/222; B64G 1/64; Y10T 403/59; Y10T 403/1641; Y10T 403/22; F41A 1/00; F41A 1/02
See application file for complete search history.

(56) References Cited

U.S. PATENT DOCUMENTS 2,899,898 A * 8/1959 Goss ..... F02K 7/10 102/377
2,945,704 A * 7/1960 Korn ..... F16B 5/06 102/473
3,190,221 A * 6/1965 Gariboldi ..... F42B 15/36 102/377

(Continued)

FOREIGN PATENT DOCUMENTS

EP 0 335 761 A1 10/1989
EP 2 662 288 A2 11/2013

OTHER PUBLICATIONS

International Search Report and Written Opinion of the International Search Authority for corresponding International application No. PCT/US2017/021828 dated Dec. 12, 2017.

*Primary Examiner* — Joshua E Freeman
*Assistant Examiner* — Bridget A Cochran
(74) *Attorney, Agent, or Firm* — Renner, Otto, Boisselle & Sklar, LLP

(57) ABSTRACT

A missile or other flight vehicle has a stage separation mechanism for separating a downstream stage from an upstream portion of the missile. The mechanism includes one or more holes in fluid communication with a cavity between the upstream and downstream portions of the missile. The holes are located downstream of one or more shocks produced by one or more local variations in the outer surface shape of the missile. The one or more local variations in outer surface shapes produce the one or more shocks (Continued)

as the missile is flown at supersonic speeds. These shock(s) produce downstream pressure rises, and these pressure increases are communicated to the cavity by the hole(s). The increased pressure in the cavity provides a mechanism for separating the downstream stage from the upstream portion of the missile, after release of a mechanical coupling between the upstream portion and downstream stage.

12 Claims, 2 Drawing Sheets

(56) References Cited

U.S. PATENT DOCUMENTS 3,260,204 A * 7/1966 Wilkey, Jr. ..... F42B 10/30 102/378
3,262,266 A * 7/1966 Howison ..... F02K 9/763 102/377
3,310,947 A * 3/1967 Shryock ..... F02K 9/38 60/225
3,362,290 A * 1/1968 Carr ..... F42B 15/36 102/378
3,727,569 A * 4/1973 Johnson ..... F42B 15/22 114/20.1
4,348,956 A * 9/1982 Schmidlin ..... F16B 7/0413 102/377
4,628,821 A * 12/1986 Madderra ..... F42B 15/36 102/377
4,745,861 A * 5/1988 Fenton ..... F02K 9/30 102/377
4,903,605 A * 2/1990 Dupuis ..... F42B 15/36 102/377
5,286,135 A * 2/1994 James ..... F16B 3/04 403/319
5,598,990 A * 2/1997 Farokhi ..... B64C 23/06 244/198
5,619,010 A * 4/1997 Holm ..... F42B 12/60 102/357
5,806,791 A * 9/1998 Hatalsky ..... F02K 9/805 244/3.24
6,557,475 B1 * 5/2003 Nygren ..... F42B 15/36 102/377
8,141,491 B1 * 3/2012 Travis ..... F42B 15/38 102/377
8,757,065 B2 * 6/2014 Fjerstad ..... F42B 15/36 102/377
2005/0193916 A1 * 9/2005 Cleveland ..... B64G 1/645 102/378
2005/0229587 A1 * 10/2005 Hervio ..... F02K 9/978 60/230
2006/0027083 A1 * 2/2006 Lee ..... F16B 31/005 89/1.14
2007/0271922 A1 * 11/2007 Travis ..... F15B 15/1447 60/632
2008/0041265 A1 * 2/2008 Geswender ..... F02K 7/10 102/476
2010/0051751 A1 * 3/2010 Mueller ..... B64G 1/14 244/158.9
2010/0224719 A1 * 9/2010 Johansson ..... F42B 10/32 244/3.1
2010/0276544 A1 * 11/2010 Hlavacek ..... F42B 12/60 244/137.1
2011/0000548 A1 * 1/2011 Sanders ..... B64D 33/02 137/1
2011/0072957 A1 * 3/2011 Travis ..... F41F 3/042 89/1.806
2011/0315248 A1 * 12/2011 Simpson ..... F15D 1/003 137/561 R
2012/0018021 A1 * 1/2012 Babinsky ..... F15C 1/16 137/808
2012/0137653 A1 * 6/2012 Facciano ..... F41F 3/055 60/204
2012/0145028 A1 * 6/2012 Travis ..... F42B 10/66 102/377
2012/0181373 A1 * 7/2012 Facciano ..... B64G 1/002 244/3.15
2013/0043352 A1 * 2/2013 Bahn ..... B64G 1/40 244/171.1
2015/0097085 A1 * 4/2015 Holemans ..... B64G 1/641 244/173.1
2015/0211832 A1 * 7/2015 Travis ..... F42B 15/36 285/90
2016/0320165 A1 * 11/2016 Rovinsky ..... F42B 12/22

* cited by examiner

STAGE SEPARATION MECHANISM AND METHOD

GOVERNMENT LICENSE RIGHTS

This invention was made with government support under Contract No. HQ0276-10-C-0005 awarded by the Department of Defense. The government has certain rights in the invention.

FIELD OF THE INVENTION

The invention is in the field of stage separation mechanisms and methods, such as for missiles or other flight vehicles.

DESCRIPTION OF THE RELATED ART

Missiles and launch vehicles often require multiple stages. Active stage separation mechanisms, such as retro-rockets or springs or other forceful separation mechanisms, have often been used in the past to ensure safe stage separation. These active separation mechanisms add complexity, weight, and cost to the missile or launch vehicle. In passive stage separation, it has generally been the case that the lower stage typically has a much larger frontal area than the upper stage, so that the resulting aerodynamic forces on the lower stage are greater than that of the upper stage, which causes the two bodies to separate.

SUMMARY OF THE INVENTION

A separation mechanism includes producing a shock during supersonic flow, and using one or more holes to transfer high pressure into a cavity operatively coupled to the missile part or portion, such as a downstream stage, to be separated.

According to an aspect of the invention, a missile or other flight vehicle includes: an upstream portion; and a downstream portion aft of the upstream portion; wherein one of the portions has a local variation in surface shape, whereby the local variation in surface shape produces a shock in supersonic flow; and wherein one or both of the portions have one or more holes, downstream of the shock produced by the local variation in surface shape, in fluid communication with a cavity defined at least in part by the portions, and between the portions.

According to an embodiment of any paragraph(s) of this summary, the local variation in surface shape includes protrusions protruding radially outward from at least one of the portions.

According to an embodiment of any paragraph(s) of this summary, the protrusions include a series of tabs protruding radially outward from at least one of the portions.

According to an embodiment of any paragraph(s) of this summary, the protrusions include one or more of flow obstructions that cause a shock to form, for instance by protruding radially outward into fluid flow around the missile or other air vehicle.

According to an embodiment of any paragraph(s) of this summary, the protrusions are spaced around a circumference of the missile (or other air vehicle).

According to an embodiment of any paragraph(s) of this summary, the protrusions protrude at least 2.5 cm (1 inch) out from a fuselage of the missile (or other air vehicle).

According to an embodiment of any paragraph(s) of this summary, the holes are 7.6 cm (3 inches) or less downstream from the protrusions.

According to an embodiment of any paragraph(s) of this summary, the local variation in surface shape includes changes in a diameter in one or both of the portions.

According to an embodiment of any paragraph(s) of this summary, the downstream portion includes a rocket booster.

According to an embodiment of any paragraph(s) of this summary, the downstream portion includes a thruster.

According to an embodiment of any paragraph(s) of this summary, the local variation in surface shape is in the upstream portion.

According to an embodiment of any paragraph(s) of this summary, the local variation in surface shape is in the downstream portion.

According to an embodiment of any paragraph(s) of this summary, the holes are in the upstream portion.

According to an embodiment of any paragraph(s) of this summary, the holes are in the downstream portion.

According to an embodiment of any paragraph(s) of this summary, the missile (or other air vehicle) further includes one or more latches that mechanically couple the portions together.

According to an embodiment of any paragraph(s) of this summary, the missile (or other air vehicle) further includes one or more explosive bolts that release a mechanical coupling that mechanically couples the portions together.

According to an embodiment of any paragraph(s) of this summary, the mechanical coupling includes a band clamp.

According to an embodiment of any paragraph(s) of this summary, a diameter of the cavity is at least 50% of a diameter of the downstream portion.

According to an embodiment of any paragraph(s) of this summary, an effective area of the downstream portion that pressure in the cavity acts upon is at least 50% of a cross-sectional area of the missile perpendicular to an axial direction along the missile.

According to an embodiment of any paragraph(s) of this summary, the missile is a ballistic missile.

According to an embodiment of any paragraph(s) of this summary, the local variation in surface shape is upstream of the holes.

According to an embodiment of any paragraph(s) of this summary, the local variation in surface shape is downstream of the holes.

According to an embodiment of any paragraph(s) of this summary, the local variation in surface shape includes a reduction in diameter at an aft end of the upstream portion.

According to an embodiment of any paragraph(s) of this summary, the local variation in surface shape includes an increase in diameter at a forward end of the downstream portion.

According to an embodiment of any paragraph(s) of this summary, both of the portions have the same diameter over most of their lengths.

According to another aspect of the invention, a missile (or other air vehicle) includes: an upstream portion; and a downstream portion aft of the upstream portion; wherein one of the portions has one or more protrusions extending into flow around the missile, whereby the one or more protrusions produce a shock in the flow when the flow is supersonic; and wherein one or both of the portions have one or more holes, downstream of the shock produced by the local variation in surface shape, in fluid communication with a cavity defined at least in part by the portions, and between the portions.

According to yet another aspect of the invention, a method of separating a downstream portion from an upstream portion of a missile (or other air vehicle) includes the steps of: producing a shock in airflow past the missile (or other air vehicle) as the missile (or other air vehicle) flies supersonically; elevating pressure in a cavity between the upstream portion and the downstream portion from an elevated pressure region downstream of the shock; and separating the downstream portion from the upstream portion using pressurized air in the cavity.

According to an embodiment of any paragraph(s) of this summary, the elevating pressure includes elevating pressure in the cavity at least 7,000 Pa (1 psi) above ambient pressure outside the missile.

According to an embodiment of any paragraph(s) of this summary, the elevating pressure includes elevating pressure in the cavity at least 20,000 Pa (3 psi) above ambient pressure outside the missile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A missile or other flight vehicle has a stage separation mechanism for separating a downstream stage from an upstream portion of the missile. The mechanism includes one or more holes in fluid communication with a cavity between the upstream and downstream portions of the missile. The holes are located downstream of one or more shocks that are produced by one or more local variations in the outer surface shape of the missile. The one or more local variations in outer surface shapes produce the one or more shocks as the missile is flown at supersonic speeds. These shock(s) produce downstream pressure rises, and these pressure increases are communicated to the cavity by the hole(s). The increased pressure in the cavity provides a mechanism for separating the downstream stage from the upstream portion of the missile, after release of a mechanical coupling between the upstream portion and downstream stage. The variations in the outer surface shape may be one or more protrusions, such as tabs, that protrude beyond the boundary layer into the supersonic flow around the missile. Alternatively the variation in outer surface shape may be a variation in diameter of the missile, such as a difference in diameter between the upstream and downstream portions, or a variation in diameter of one or both of the portions, such as a narrowing or widening of a part of one or both of the portions.

Figure 1:
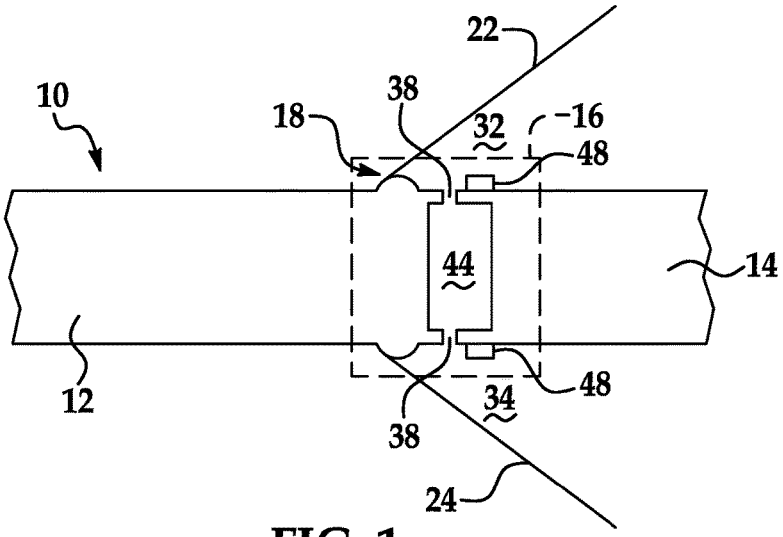
FIG. 1 is a schematic view of a flight vehicle (a missile) according to an embodiment of the present invention.

FIG. 1 shows a missile 10 that has an upstream (or forward) portion (or stage) 12, and a downstream (or aft) stage (or portion) 14 that is aft of, and is to be separated from, the upstream portion 12 during the flight of the missile 10. The terms "upstream" and "downstream" are used herein to refer to directions along the central longitudinal axis of the missile 10, with "upstream" used to indicate the forward axial direction toward the nose of the missile 10, and "downstream" used to indicate the rearward or aftward axial direction toward the tail of the missile 10. The downstream stage 14 for example may be a booster that provides thrust to accelerate the missile 10, and then is discarded after use. The downstream stage 14 may be one of multiple stages that are jettisoned from the missile 10 during flight, for example being one of multiple individually-separable boosters.

A separation mechanism 16 is used to mechanically decouple the downstream stage 14 from the upstream portion 12. Parts of the separation mechanism 16 may also be considered parts of the upstream portion 12 and/or the downstream stage 14.

The separation mechanism 16 includes a shock-producing mechanism 18 for producing one or more shocks, such as the shocks 22 and 24, when the missile 10 flies supersonically. As described in greater detail below with regard to specific embodiments, the shock-producing mechanism 18 may involve a surface feature or a variation in the outer surface shape of the missile 10. The variation in surface shape may involve one or more protrusions on the outer surface of the missile 10, such as tabs, to produce one or more shocks. Alternatively the variation in surface shape may be a widening and/or narrowing of the diameter of the missile 10 (in either or both of the portions 12 and 14), sufficient to create one or more shocks.

The shocks 22 and 24 produce high pressure in regions, such as the regions 32 and 34, just downstream of the shocks 22 and 24. One or more holes 38 are located in the regions 32 and 34 just downstream of the shocks 22 and 24. The holes 38 are in fluid communication with a cavity 44 that is between the upstream portion 12 and the downstream stage 14. The cavity 44 is defined at least in part by the upstream portion 12 and the downstream stage 14. The elevated pressure in the regions 32 and 34 is communicated to the cavity through the holes 38. This elevated pressure in the cavity 44 facilitates separation of the downstream stage 14 from the upstream portion 12. Once the downstream portion 14 is mechanically disconnected from the upstream portion 12, the elevated pressure in the cavity 44 pushes the portions 12 and 14 away from one another, producing separation between them. The force separating the portions 12 and 14 from each other helps avoid any post-separation contact between the downstream stage 14 and the upstream portion 12.

The cavity 44 may be of sufficient size such that the elevated pressure acts on a significant area of the missile portions 12 and 14. For example the cavity 44 may have a diameter that is at least 50% of the diameter of the upstream portion 12 and/or the downstream stage 14. As another example, the cavity 44 may have an effective area (an area upon which the pressure in the cavity 44 acts on the upstream portion 12 and/or the downstream stage 14) that is at least 50% of the cross-sectional area of the upstream portion 12 and/or the downstream stage 14.

The separation mechanism 16 may include a separable mechanical coupling 48 between the upstream portion 12 and the downstream stage 14. Examples of suitable couplings include releasable latches and couplings involving explosive bolts or other mechanisms that do or do not use explosives to bring about separation.

The shock-producing mechanism 18 may include protrusions that extend out of the fuselage, either a series of such protrusions, for example located at discrete locations around the perimeter of the missile 10, or as a ridge extending continuously around the perimeter. For example, the protrusions may be a series of tabs. Such protrusions may be fixed in location and in extension, or alternatively may be deployable protrusions, for example spring-loaded or otherwise extending members or structures that selectively extend out of a fuselage of the missile 10. Such extending members or protrusions may be integrated in operation with the separation mechanism 16, for example with the extending protrusions deployed prior to or at the same time that the mechanical coupling 48 is activated to separate the downstream stage 14 from the upstream portion 12.

Alternatively the shock-producing mechanism 18 may involve a change in diameter and/or shape of the portions 12 and/or 14. For example the downstream stage 14 may have a forward end that has a greater diameter than an aft end of the upstream portion 12, with a shoulder on the forward end of the downstream stage 14 constituting a shoulder that produces a shock or shocks.

The embodiments are described herein with regard to missiles. However the stage separation mechanisms and methods are equally adaptable to other types of flight vehicles, such as launch vehicles.

Figure 2:
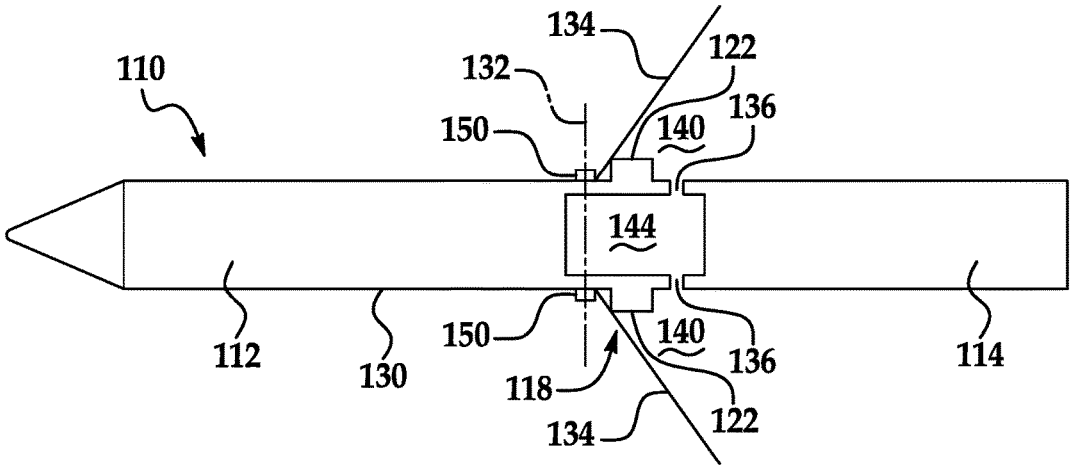
FIG. 2 is a schematic view showing a flight vehicle (missile) according to another embodiment of the present invention.
Figure 3:
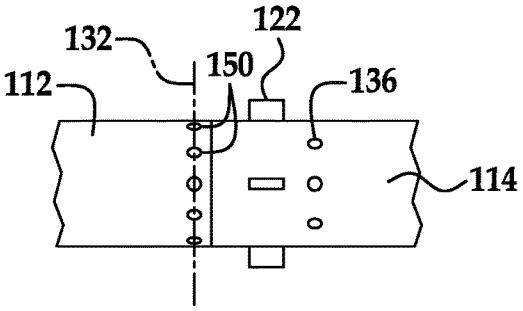
FIG. 3 is a side view showing part of the missile of FIG. 2.

FIGS. 2 and 3 show one specific embodiment, a missile 110 which that has a downstream stage 114 that separates from an upstream portion 112 along a separation plane 132. A forward end 118 of the downstream stage 114 has a series of protrusions 122, which in the illustrated embodiment are tabs that protrude from a fuselage 130 of the missile 110. The tabs 122 are aft of a separation plane 132 along which the downstream stage 114 is separated from the upstream portion 112.

The tabs 122 produce one or more shocks 134. Downstream of the tabs (or other protrusions) 122 are holes 136 in the downstream stage 114. The holes 136 allow fluid communication between a region (or regions) 140 outside of the fuselage 130 and downstream of the tabs 122, and a cavity or chamber 144 inside the fuselage 130 and between the upstream portion 112 and the downstream stage 114. The shock(s) 134 produce higher pressure in the region(s) 140 immediately downstream of the shock(s) 134. The higher pressure in the region(s) 140 is transmitted by the holes(s) 136 into the cavity or chamber 144 for use in separating the downstream stage 114 from the upstream portion 112.

It is desirable for the holes 136 to be close to the shocks 134, as the pressure increase caused by the shocks 134 decays as one moves further downstream of the shocks 134. For example the holes 136 may be less than 10 cm (4 inches), or may be less than 7.6 cm (3 inches) downstream in a longitudinal direction from the tabs 122, although the holes 136 may be any of a variety of other suitable distances downstream of the tabs 122 and the shock fronts 134. As another alternative, the holes 136 may be 2.5 to 15 cm (1 to 6 inches) downstream of the tabs 122. The holes 136 may be a similar distance, such as any of the various ranges described above, downstream of the shock 134, for example measure from the location where the shock 134 is closest to the fuselage of the missile 110.

The pressure rise in the chamber 144 may be about 20,000 Pascals (3 psi) above the ambient pressure away from the shock(s) 134. More narrowly, the pressure rise in the chamber 144 may be about 7,000 Pascals (1 psi) above the ambient pressure away from the shock(s) 134. These are just an example of values, and a wide variety of other values are possible.

As FIG. 3 shows the separation may be accomplished by a series of explosive bolts 150 around the fuselage 130. Actuating the bolts 150 severs the connection between the downstream stage 114 and the upstream portion 112. One or more bolts may alternatively be used to sever or otherwise break a mechanical connection between the portions 112 and 114. One example is a band clamp holding together the portions 112 and 114, with the ends of the band clamp held together with an explosive bolt.

Many alternatives are possible. The protrusions 122 may be any of a variety of suitable shapes, and may have any of a variety of orientations. Some possible shapes and/or orientations may be preferable relative to others, in terms of producing suitable shocks at desirable locations and/or for not adding excessive levels of drag to the missile 110. The protrusions or tabs (flow obstructions) 122 may be flat, or alternatively may be nonplanar. Instead of a series of separate protrusions, such as the series of tab spaced around the fuselage 130, a shock may be generated by a single variation in surface shape, such as ridge or recess extending partially or fully around the circumference of the fuselage 130.

The local variations in the outer surface shape of the missile therefore may have any of a variety of forms. The phrase "local variations in the surface shape of the missile" should be understood broadly to refer to continuous or discontinuous changes in the outer surface shape, consistent with producing one or more shocks in flow past the missile. Such variations in surface will generally include surface shape variations in the longitudinal (axial) direction.

The protrusions 122 may be fixed protrusions, or alternatively may be deployable protrusions, for example being spring-loaded to deploy into the air stream around the missile 110. Control of deployment of deployable protrusions may be coordinated with actuation of the separation mechanism for separating the downstream stage 114, for example by controlling timing of the deployment of the deployable protrusion to allow for filling of the cavity or chamber 144 with high-pressure air from downstream of the shock(s) 134, before the actuation of a mechanism for mechanically separating the downstream stage 114 from the upstream missile portion 112.

The protrusions 122 may be large enough to extend beyond the boundary layer flow around the missile 110. For example the protrusions 122 may protrude at least 2.5 cm (1 inch) beyond the circumference of the main fuselage 130, although this is just an example value and many other suitable sizes for the protrusions 122 are possible.

There may be various numbers of the holes 136, with various sizes and/or configurations to accomplish the purpose of increasing the pressure within the cavity or chamber 144. The holes 136 may all have the same diameter, or may have different diameters. The holes 136 may be evenly spaced around the circumference of the missile fuselage 130, or alternatively may be unevenly spaced. The holes 136 may have their axes aligned in radial directions, or alternatively may be otherwise oriented, such as by being slanted in an axial and/or a circumferential direction, or by having a serpentine and/or curved shape, to give but a few examples.

Alternatives to the use of the bolts 150 include use of other configurations, such as use of an explosive cord to sever the connection between the upstream missile portion 112 and the downstream stage 114. Mechanical couplers, such as latches, are another possible alternative. Such latches may be actively released when separation is desired.

The protrusions 122 may be located in the upstream portion 112, as opposed to the illustrated configuration in which the protrusions 122 are part of the downstream stage 114. If the protrusions 122 are part of the upstream portion 112, the holes 136 also may be in the upstream portion 112, or alternatively the holes 136 may remain part of the downstream stage 114.

In the illustrated embodiment the upstream portion 112 and the downstream stage 114 have the same diameter. In such a configuration there is a need for some structure of mechanism to generate a shock or shocks. Alternatively the portions 112 and 114 may have different diameters, which itself may be used to generate a shock that causes a pressure rise.

Figure 4:
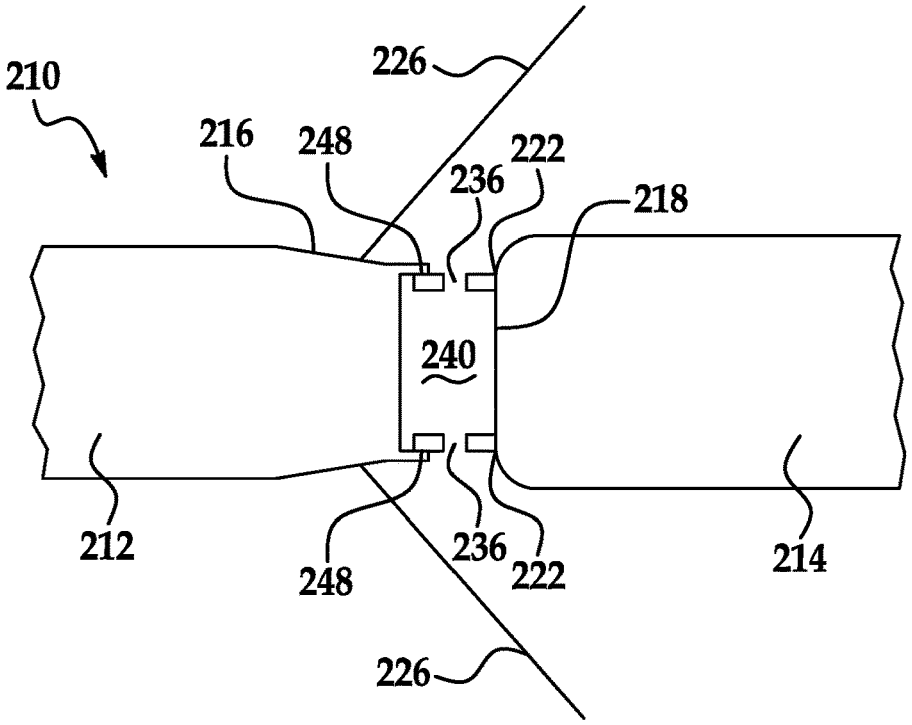
FIG. 4 is a side view showing part of a flight vehicle (a missile) according to still another embodiment of the invention.
Figure 5:
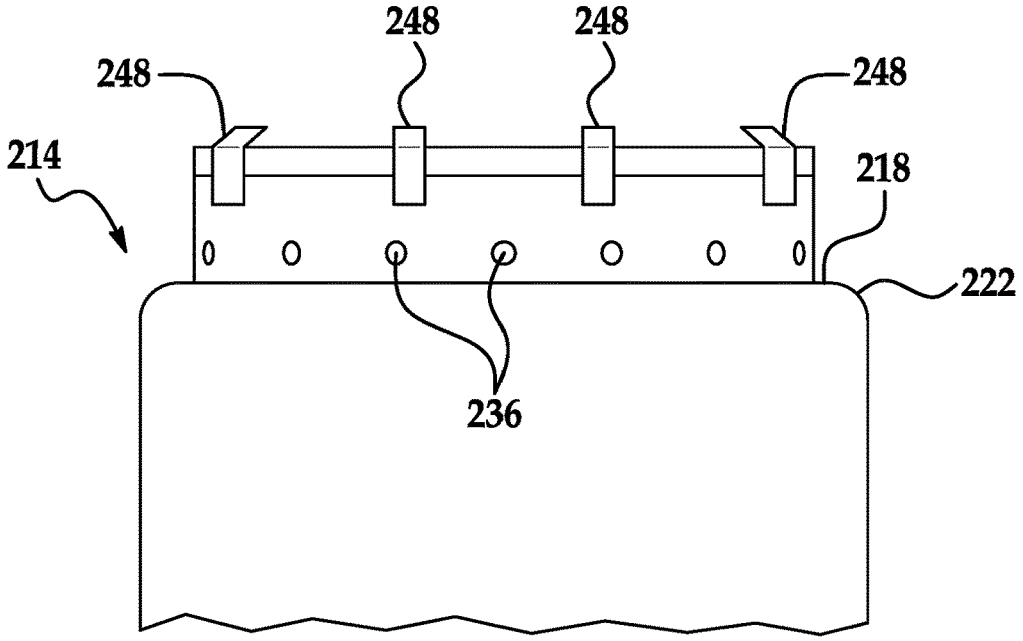
FIG. 5 is an oblique view showing part of a downstream stage of the missile of FIG. 4.

FIGS. 4 and 5 show another embodiment, a missile 210 that has a variation in diameter as the variation in surface shape that generates a shock. The missile 210 has a downstream stage 214 that separates from an upstream missile portion 212. An aft end 216 of the upstream portion 212 has a reduced diameter, tapering down from the relatively wide diameter along most of the upstream portion 212. The downstream stage 214 has a rounded forward end 218, which has a shoulder 222 that extends radially out further than the upstream portion aft end 216. The shoulder 222 radially extends beyond at least part of the aft end 216. This change of shape can cause a shock 226 to form upstream of the shoulder 222. The shock 226 is upstream of holes 236 that transmit the elevated pressure from the region downstream of the shock 226, to a cavity or chamber 240 that is between the upstream portion 212 and the downstream stage 214.

There also may be a series of latches 248 coupling together the portions 212 and 214. The latches 248 may have any of a variety of suitable configurations for mechanically coupling the portions 212 and 214 together, while allowing for later separation of the downstream stage 214 from the upstream missile portion 212. The latches 248 themselves may be at least partially responsible for triggering or enhancing the shock 226.

Other characteristics of the missile 210 may be similar to those of the missile 110. More generally the various characteristics described herein with regard to one of the embodiments may also be used in other embodiments.

The various missiles described herein may be ballistic missiles, with stage separation during a boost phase, where the missile flies supersonically through the atmosphere. Alternatively the stage separation described herein may be usable with other types of missiles, such as tactical missiles, as well as with other types of flying vehicles, such as launch vehicles or multi-stage supersonic flight vehicles.

The separation mechanism allows for trouble-free separation, providing rapid and even separation of parts, without adding significant weight, cost, or complexity to the missile or other flight vehicle. The mechanism described herein is also reliable and involves a minimum of moving parts (or even no moving parts).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A flight vehicle comprising:

an upstream portion; and a downstream portion aft of the upstream portion;

wherein one of the portions has a local variation in surface shape, whereby the local variation in surface shape produces a shock in supersonic flow;

wherein one or both of the portions have one or more holes, downstream of both the local variation in surface shape and the shock produced by the local variation in surface shape, in fluid communication with a cavity defined at least in part by the portions, and between the portions;

wherein the local variation in surface shape includes protrusions protruding radially outward from at least one of the portions;

wherein the protrusions include a series of tabs protruding radially outward from at least one of the portions;

wherein the holes are in the downstream portion; and wherein the holes allow fluid communication between the cavity and a region that is both outside of the downstream portion, and downstream of the tabs.

2. The flight vehicle of claim 1, wherein the protrusions protrude at least 2.5 cm (1 inch) out from a fuselage of the flight vehicle.

3. The flight vehicle of claim 1, wherein the holes are 7.6 cm (3 inches) or less downstream from the protrusions.

4. The flight vehicle of claim 1, wherein the downstream portion includes a rocket booster.

5. The flight vehicle of claim 1, wherein the local variation in surface shape is in the upstream portion.

6. The flight vehicle of claim 1, wherein the local variation in surface shape is in the downstream portion.

7. The flight vehicle of claim 1, further comprising one or more latches that mechanically couple the portions together.

8. The flight vehicle of claim 1, further comprising one or more explosive bolts that mechanically couple the portions together.

9. The flight vehicle of claim 1, wherein a diameter of the cavity is at least 50% of a diameter of the downstream portion.

10. The flight vehicle of claim 1, wherein an effective area of the downstream portion that pressure in the cavity acts upon is at least 50% of a cross-sectional area of the flight vehicle perpendicular to an axial direction along the flight vehicle.

11. The flight vehicle of claim 1, wherein the flight vehicle is a ballistic missile.

12. The flight vehicle of claim 1, wherein the protrusions are spaced around a circumference of the flight vehicle.

* * * * *